United States Patent [19]

Rhee

[11] 4,151,613

[45] May 1, 1979

[54] PROTECTIVE DEVICE FOR THE BUTTOCKS AND HIPS OF A PERSON FOR USE IN SKATEBOARDING

[76] Inventor: Jhoon G. Rhee, 4068 Rosamora Ct., Arlington, Va. 22207

[21] Appl. No.: 885,031

[22] Filed: Mar. 9, 1978

[51] Int. Cl.[2] ..... A41D 13/00

[52] U.S. Cl. ..... 2/2

[58] Field of Search ..... 2/2

[56] References Cited

U.S. PATENT DOCUMENTS

| | | | |
|---|---|---|---|
| 1,239,980 | 9/1917 | Stewart | 2/2 |
| 2,266,886 | 12/1941 | McCoy | 2/2 |
| 2,516,598 | 7/1950 | Selkirk | 2/2 |
| 2,621,327 | 12/1952 | Amoroso | 2/2 |
| 2,805,418 | 9/1957 | Sowle | 2/2 |
| 3,945,041 | 3/1976 | Rhee | 2/2 |

*Primary Examiner*—Werner H. Schroeder
*Assistant Examiner*—Doris L. Troutman
*Attorney, Agent, or Firm*—James C. Wray

[57] ABSTRACT

This invention relates to a protective device adapted to protect the buttocks and hips of a person engaging in the sport of skateboarding. The device is constructed from a resilient material, such as plastic foam which may be covered with a tough, pliable plastic material or the like, and comprises a generally rectangular member having two cutout portions in the upper part and three arm members, through each of which a belt member is passed and the lower portion of the device comprises a pair of double stranded cord members. The device is secured around the waist by the belt member, and the cord members passing around the legs to retain the lower portion of the device on the wearer.

4 Claims, 4 Drawing Figures

PROTECTIVE DEVICE FOR THE BUTTOCKS AND HIPS OF A PERSON FOR USE IN SKATEBOARDING

BACKGROUND OF THE INVENTION

This invention relates to a protective device adapted to be worn by a person while engaging in the sport of skateboarding, which has undergone an immense growth in popularity in recent years. However, in a recent survey, it was estimated that more than 100,000 various types of skateboard injuries occurred in one year with many of them attributed to children 10 to 14 years old. In almost all cases, the injured victims had not been wearing any kind of protective equipment.

A person engaging in the sport can possibly lose his balance, slip off the skateboard, or the skateboard slips out from under the person, etc. When such happens and the person falls backward, he may land on his buttocks or hips thereby causing injuries thereto.

The present invention provides a novel protective device adapted to shield a person's buttocks and hips when engaging in the sport of skateboarding.

SUMMARY OF THE INVENTION

It is an object of this invention to provide a novel protective unitary device for a person's buttocks and hips to be worn while engaging in the sport of skateboarding.

Another object of this invention is to provide a novel protective device for the buttocks and hips of a person of simplified construction, comprising a resilient energy-absorbing plastic foam covered with a tough, pliable plastic material, and which is relatively inexpensive.

A further object of the invention is to provide a device for wearing around a person's hips and buttocks which protects them against injury when one falls.

Generally, the protective device comprises a flat rectangular member made from a resilient material preferably of energy-absorbing plastic foam material which is shaped and has a configuration adapted to be worn around the hips and buttocks of a person while engaging in the sport of skateboarding. Suitable means are provided for securing the device around the person.

BRIEF DESCRIPTION OF THE INVENTION

DETAILED DESCRIPTION OF THE INVENTION

Figure 2:
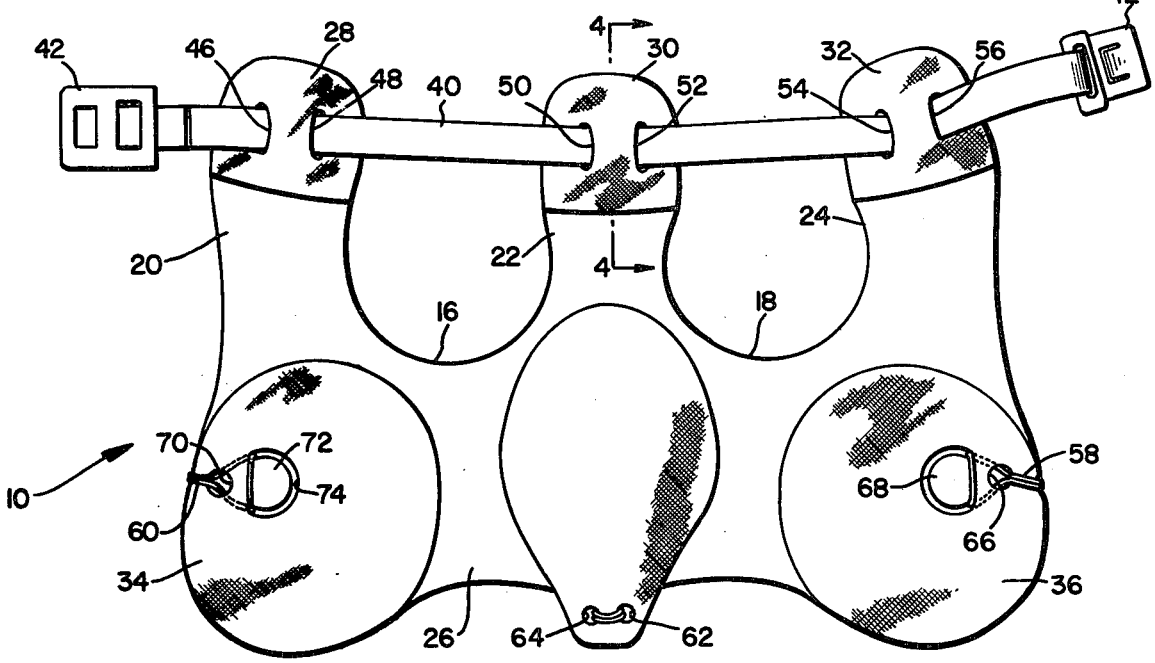
FIG. 2 is a perspective view of the outer side of the protective device.
Figure 3:
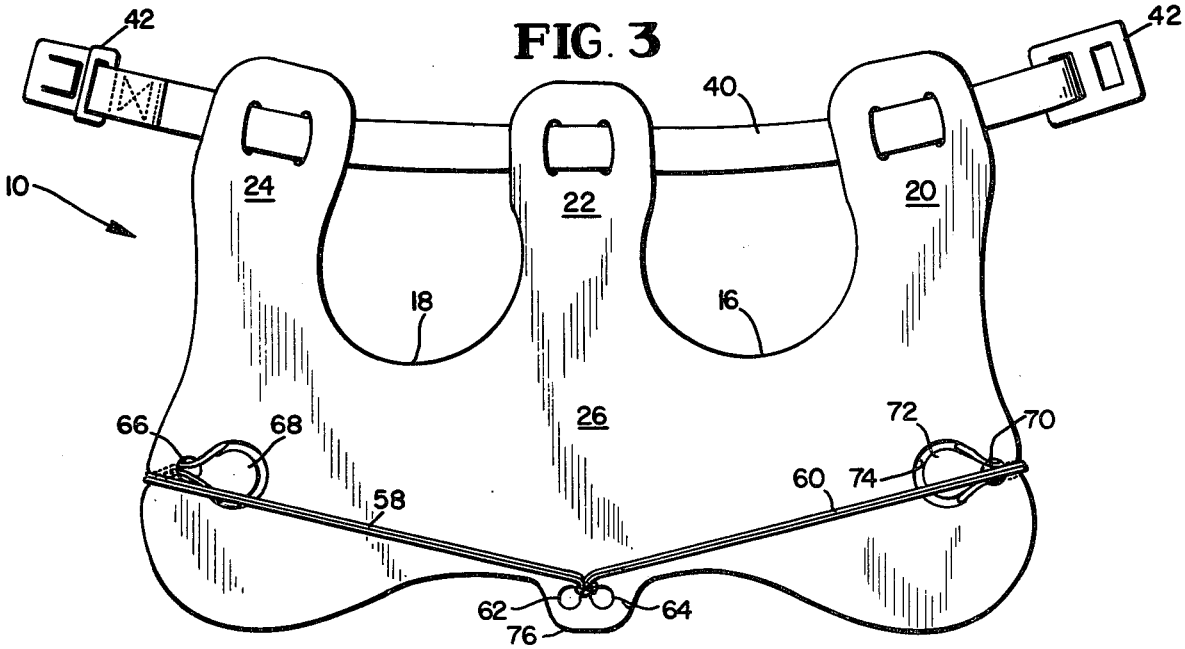
FIG. 3 is a perspective view of the inner side of the protective device.

The protective device of the invention is generally indicated by the numeral 10 in FIGS. 2 and 3. The device, preferably unitary, is formed or molded from a suitable resilient material 12 capable of absorbing energy, such as a suitable plastic material, e.g. polystyrene or polyurethane foam, rubber foam, and the like. In a preferred embodiment, a suitable surface coating or casing 14, preferably smooth, covers the entire resilient material 12 throughout, which is tough, pliable, tear resistant material, preferably comprising a suitable plastic material, or the like. The casing or coating 14 can be formed during heating or molding of the resilient foam material to produce a fused coating thereon. Alternatively, the surface coating 14 can be applied on the resilient material by dipping or by applying and securing a coating of a suitable plastic material or the like. Materials of plastic are preferred for the coating since there are available on the market many tough, rugged, pliable materials such as polyvinylchloride, etc. However, it is also contemplated within the concept of the invention that suitable rugged leather or fabric materials, and the like, can be secured to the resilient material and used to cover the resilient material. The coating or casing used should provide a flexible, tough covering which is resistant to tearing or abrasion.

Although, the device has been described above in the preferred embodiment as comprising a surface coating which covers the entire resilient plastic foam throughout, it is contemplated that the surface coating can be applied to only one surface, i.e. the outer surface, while the inner surface comprises the exposed foam. Various plastic foam materials are available today which are tear-resistant and, therefore, do not require a surface coating.

The device 10 is generally an overall rectangular member comprising rounded cutout sections 16 and 18 resulting in arm members 20, 22 and 24, and a main body portion 26. Each arm member 20, 22 and 24 is reinforced at its end with a tough fabric material 28, 30 and 32 respectively, or the like which is beneath the outer coating 14. The main body portion 26 is likewise reinforced with a tough fabric material at strategic portions thereof. Thus, the corner portions are reinforced at 34 and 36, and the center portion at 38.

The reinforcing material is for the purpose of providing additional strength to the device at portions where securing means for the device are provided. A belt member 40 comprising buckle 42 and tongue member 44 passes through each arm member through slots 46 and 48 in arm 20, slots 50 and 52 in arm 22, and slots 54 and 56 in arm 24.

In the main body 26 of the device, elastic cord means 58 and 60 are provided. Cord means 58 is double stranded and one end is secured to a pair of hole means 62 and 64 and extends inside the device and around the edge through a hole 66 on the front of the device to a tongue member 68 over which the end portion of the double stranded cord means is secured. Similarly, cord means 60 is secured to hole means 62 and 64, extends inside the device around the edge through a hole 70 and secured to a tongue member 72. Hole means 62 and 64 are contained in a section 76 which extends below the body 26. Section 76 serves a dual purpose in extending across and protecting the tailbone of a person.

The securing devices 68 and 72 are formed integral with the main body and comprise e.g. with device 72 an annular slot 74. The end of the cord means 60 is looped over the device 72 by passing it through slot 74. Device 68 is similarly formed and used for looping the end of cord means 58.

Figure 1:
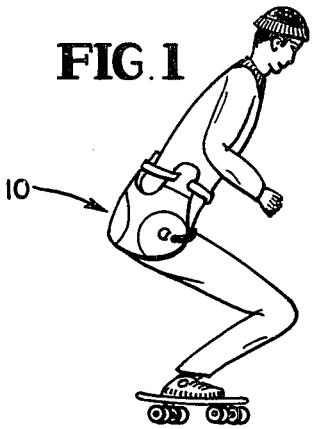
FIG. 1 is a perspective view of the protective device as worn by a person while engaging in the art of skateboarding.
Figure 4:
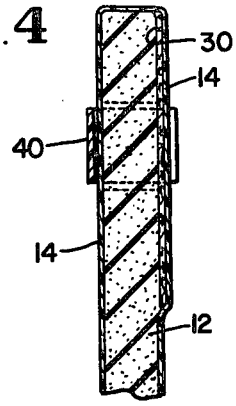
FIG. 4 is a sectional view taken along line 4—4 of FIG. 2.

The device is worn as shown in FIG. 1 by placing each of one's legs between the cord means 58 and 60 and the body 26 of the device. The device is then pulled up around a person's waste whereby the main body portion 26 covers the buttocks and both hips of the person. Belt 40 is then secured around the waist by inserting tongue member 42 in buckle 42 and adjusted if necessary.

As worn and in use when skateboarding, the device 10, during an accidental fall from a skateboard, protects the buttocks and hips. Because of the unique construction design of the arm members and main body, bending movements of a person at his waist are not restricted.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A flexible, unitarily molded, protective device for wearing on and protecting the buttocks and hips of a person engaging in the sport of skateboarding comprising:

a. casing means having resilient means disposed therein and having a generally rectangular configuration adapted to be worn around a person's midsection and comprising cutout sections in the upper portion providing upwardly extending arm members;

b. said arm members comprising slot means containing a belt member therethrough;

c. said rectangular casing means including a lower main body portion comprising tongue means and annular slot means at each side;

d. a pair of double stranded cord means secured to the lower central portion of said main body portion and to said annular slot means on each side of said lower body portion whereby said device is worn and secured around a person's waist by securing said belt member to the person's waist and securing each of said cord means around each of the person's legs.

2. The device of claim 1 wherein said arm means and portions of said main body portion contain reinforcing means.

3. The device of claim 1 wherein said casing means comprises a molded plastic material and said resilient means are plastic foam means.

4. The device of claim 1 wherein said lower body portion comprises a central lower extending portion adapted to cover the tailbone of a person.

* * * * *